US011021871B2

(12) United States Patent
Yamaguchi et al.

(10) Patent No.: US 11,021,871 B2
(45) Date of Patent: Jun. 1, 2021

(54) POROUS SOUND-ABSORBING BOARD

(71) Applicant: KOBE STEEL, LTD., Hyogo (JP)

(72) Inventors: Zenzo Yamaguchi, Hyogo (JP); Ichiro Yamagiwa, Hyogo (JP)

(73) Assignee: KOBE STEEL, LTD., Hyogo (JP)

( * ) Notice: Subject to any disclaimer, the term of this patent is extended or adjusted under 35 U.S.C. 154(b) by 450 days.

(21) Appl. No.: 15/778,476

(22) PCT Filed: Nov. 18, 2016

(86) PCT No.: PCT/JP2016/084334
§ 371 (c)(1),
(2) Date: May 23, 2018

(87) PCT Pub. No.: WO2017/090538
PCT Pub. Date: Jun. 1, 2017

(65) Prior Publication Data

US 2019/0112805 A1 Apr. 18, 2019

(30) Foreign Application Priority Data

Nov. 27, 2015 (JP) ..... JP2015-231451
Jun. 16, 2016 (JP) ..... JP2016-120172

(51) Int. Cl.

| | |
|---|---|
| ***E04B 1/86*** | (2006.01) |
| ***G10K 11/172*** | (2006.01) |
| ***G10K 11/168*** | (2006.01) |
| ***E04B 1/84*** | (2006.01) |

(52) U.S. Cl.
CPC ..... *E04B 1/86* (2013.01); *G10K 11/168* (2013.01); *G10K 11/172* (2013.01); *E04B 2001/8461* (2013.01); *E04B 2001/8495* (2013.01)

(58) Field of Classification Search
CPC . E04B 1/86; E04B 2001/8461; G10K 11/168; G10K 11/172
USPC ..... 181/293
See application file for complete search history.

(56) References Cited

U.S. PATENT DOCUMENTS

| | | | | |
|---|---|---|---|---|
| 6,206,136 | B1 * | 3/2001 | Swindlehurst | F02C 7/045 181/290 |
| 6,977,109 | B1 * | 12/2005 | Wood | G10K 11/16 181/292 |
| 2009/0038883 | A1 * | 2/2009 | Kim | E04B 1/86 181/291 |

FOREIGN PATENT DOCUMENTS

| | | | | | |
|---|---|---|---|---|---|
| JP | S58-88700 | U | | 6/1983 | |
| JP | S60-123000 | U | | 8/1985 | |
| JP | 2004264372 | A | * | 9/2004 | G10K 11/172 |
| JP | 2008-233792 | A | | 10/2008 | |
| JP | 2008-544119 | A | | 12/2008 | |
| JP | 2012168415 | A | * | 9/2012 | G10K 11/168 |

OTHER PUBLICATIONS

International Search Report issued in PCT/JP2016/084334; dated Feb. 7, 2017.
Written Opinion issued in PCT/JP2016/084334; dated Feb. 7, 2017.

* cited by examiner

*Primary Examiner* — Forrest M Phillips
(74) *Attorney, Agent, or Firm* — Studebaker & Brackett PC

(57) ABSTRACT

A perforated sound-absorbing plate includes a perforated plate as a base material in which a large number of through holes are formed. A coating film is provided on an inner wall surface of the through hole, and a through-hole portion whose volume is smaller than a volume of the through hole is formed by the coating film.

8 Claims, 7 Drawing Sheets

POROUS SOUND-ABSORBING BOARD

TECHNICAL FIELD

The present invention relates to a perforated plate as a sound-absorbing member.

BACKGROUND ART

It has been known that sound-absorbing performance of a perforated plate as a sound-absorbing member, that is, a perforated sound-absorbing plate, can be improved by reducing diameters of holes in the perforated plate. However, a plate material for use as the sound-absorbing member is so thin that holes whose diameters are not larger than the thickness of the plate material cannot be easily made in the plate material. On the other hand, when a perforated plate is applied to a sound-absorbing member and completed as a product, the perforated plate must be often coated from the standpoint of corrosion resistance, weather resistance or the like. The perforated sound-absorbing plate absorbs sound based on the principle that sound is damped in a process in which the sound is propagated through the holes formed in the perforated sound-absorbing plate. Accordingly, when the perforated plate is coated to close the holes, there is concern that the sound-absorbing performance of the perforated plate deteriorates.

For example, Patent Literature 1 discloses a perforated sound-absorbing plate obtained by coating a perforated plate. In the technique of Patent Literature 1, a thin coating film having a thickness of 1 to 10 μm is formed on a surface of the perforated plate so as to close opening portions of through holes. Patent Literature 1 suggests that, due to the thin coating film, dust can be prevented from invading the through holes, and deterioration caused by aging or the like can be avoided, so that sound-absorbing properties and appearance properties can be improved.

CITATION LIST

Patent Literature

Patent Literature 1: JP-A-2008-233792

SUMMARY OF THE INVENTION

Technical Problems

There is no particular problem about a product in which the coating with a thickness of 1 to 10 μm is necessary and sufficient. However, a coating film having a thickness of, for example, about 20 μm is applied, by electrodeposition coating or the like for rust prevention, to a plate material needing high weather resistance, such as a steel plate constituting a car. When the coating film reaches such a thickness, the sound-absorbing performance deteriorates on a large scale in the method in which the through holes are closed by the coating film in Patent Literature 1.

In addition, an object of the method described in Patent Literature 1 in which the through holes are closed by the thin coating film having a thickness of 1 to 10 μm is not to improve the sound-absorbing performance of the perforated plate but to avoid deterioration of the sound-absorbing performance.

The present invention has been made in consideration of the aforementioned situation. An object of the present invention is not to avoid deterioration of sound-absorbing performance but to improve sound-absorbing performance of a perforated plate by coating.

Solution to Problems

A perforated sound-absorbing plate in the present invention includes a perforated plate as a base material in which a large number of through holes are formed, and a coating film is provided on an inner wall surface of the through hole, and a through-hole portion whose volume is smaller than a volume of the through hole is formed by the coating film.

Advantageous Effects of the Invention

In the present invention, the volume of the through hole in a base material is reduced by a coating film so that viscous damping due to the hole can be increased. As a result, sound-absorbing performance can be made better than that achieved by the through hole in the base material. The "viscous damping" means damping of a sound wave by friction between the sound wave and a wall surface during passing of a sound.

DESCRIPTION OF EMBODIMENTS

Embodiments of the present invention will be described below with reference to the drawings.

(Sound-Absorbing Structure Using Perforated Sound-Absorbing Plate)

Figure 1:
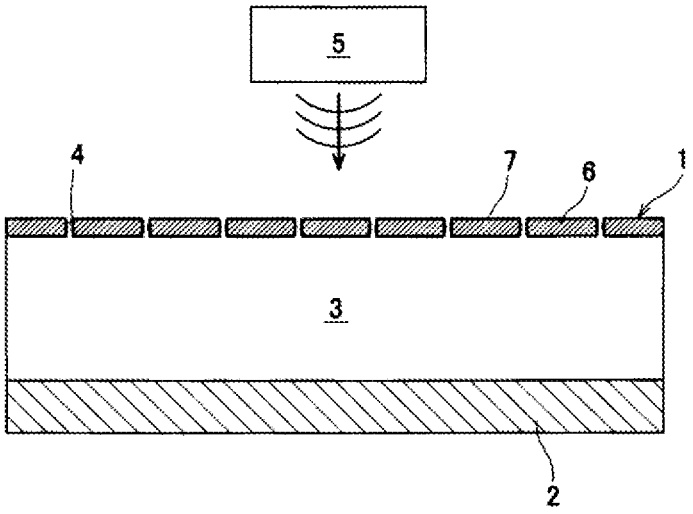
FIG. 1 A sectional view of a sound-absorbing structure including a perforated sound-absorbing plate in the first embodiment of the present invention.

As shown in FIG. 1, a perforated sound-absorbing plate 1 is placed at a predetermined distance from a plate-shaped or wall-shaped closing member 2 so that an air layer 3 is formed between the perforated sound-absorbing plate 1 and the closing member 2. The closing member 2 is a member where no holes are made, that is, a front surface thereof does not communicate with a hack surface thereof. The closing member 2 is placed on the opposite side to a noise source 5 across the perforated sound-absorbing plate 1.

The perforated sound-absorbing plate 1 in the present embodiment(s) is a sound-absorbing plate in which a coating film 7 is formed on both sides of a perforated plate 6 as a base material having a large number of through holes 4 and is formed on inner wall surfaces of the through holes 4. Examples of coating methods for forming the coating film 7 include electrodeposition coating, brush coating, spray coating and the like. Examples of materials of the perforated plate 6 and the closing member 2 include aluminum, aluminum alloys, stainless steel, iron, resin and the like.

First Embodiment (Details of Through-Hole Part)

Figure 2:
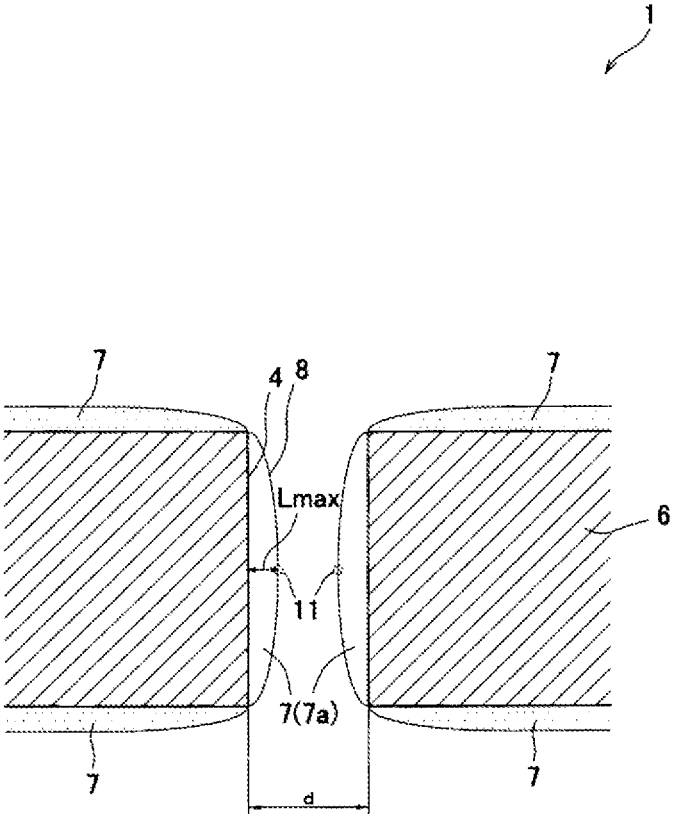
FIG. 2 An enlarged view of a through-hole part in the perforated sound-absorbing plate shown in FIG. 1.

FIG. 2 is an enlarged view of a through hole 4 in the perforated sound-absorbing plate 1 in the first embodiment shown in FIG. 1. As shown in FIG. 2, the through hole 4 of the perforated plate 6 as a base material is a columnar hole in which a coating film 7*a* is formed all over the inner wall surface of the through hole 4, and a through-hole portion 8 having a diameter smaller than a hole diameter d (diameter d) of the through hole 4 is formed by the coating film 7*a*. In addition, the volume of the hole formed in the through-hole portion 8 is smaller than the volume of the hole formed in the through hole 4 which has not been coated. The coating film 7*a* has a mountain-like shape in which the central portion thereof swells (or is thickened) in comparison with the end portions thereof in the thickness direction. Film thickness Lmax of a ridge portion 11 (maximum film-thickness portion) is smaller than ½ of the hole diameter d of the through hole 4.

In this example, a section of the through-hole portion 8 orthogonal to the thickness direction is circular at any part in the thickness direction. However, some way of coating may shape the through-hole portion 8 into not a circle (complete round) but a crushed circle, a crushed quadrangle or the like. In the present invention, the through-hole portion 8 may be such a through-hole portion which is not a complete round. In addition, in this example, the axis of the through hole 4 is aligned with the axis of the through-hole portion 8. However, in some way of coating, the axis of the through hole 4 is not aligned with the axis of the through-hole portion 8. In the aforementioned example, since the axis of the through hole 4 is aligned with the axis of the through-hole portion 8, the film thickness Lmax is smaller than ½ of the hole diameter d of the through hole 4. When the axis of the through hole 4 is not aligned with the axis of the through-hole portion 8, that is, when coating has unevenness or irregularity in the circumferential direction of the inner wall surface of the through hole 4, there may be a portion where the film thickness Lmax is not smaller than ½ of the hole diameter d of the through hole 4. It is essential to form a through-hole portion without closing the hole of the through hole 4 in spite of coating on the inner wall surface of the through hole 4.

Figure 3:
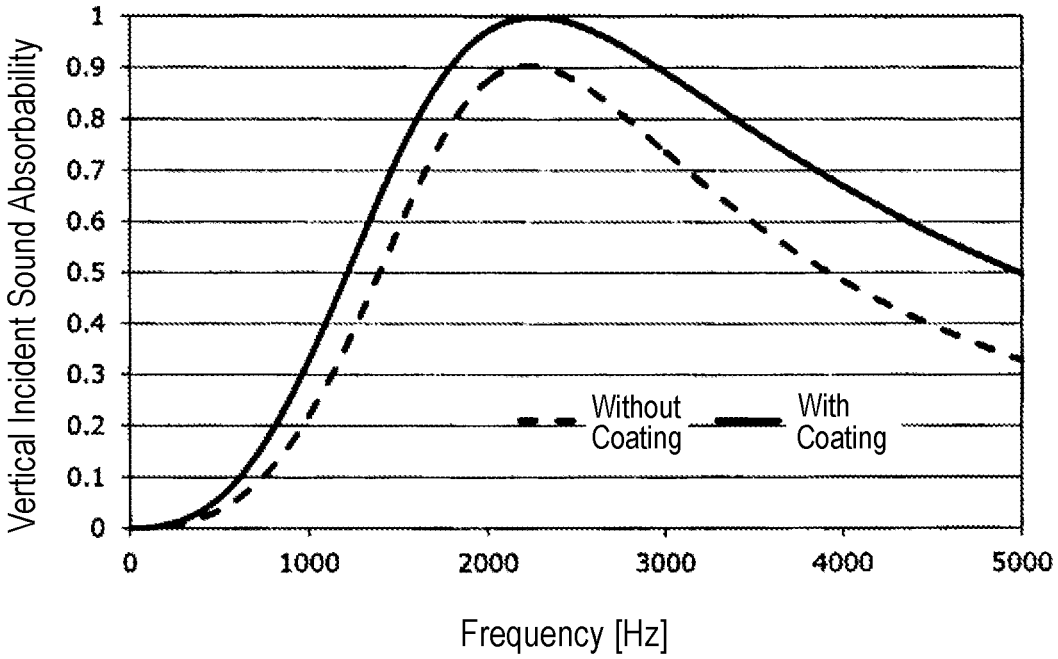
FIG. 3 A graph showing an effect obtained by reduction of the volume of a through hole by a coating film.

Here, FIG. 3 is a graph showing an effect obtained by reduction of the volume of a through hole by a coating film. The broken line in FIG. 3 designates sound absorbability in various frequency bands when the inner wall surface of the through hole 4 has not been coated. The solid line in FIG. 3 designates sound absorbability in various frequency bands when the inner wall surface of the through hole 4 has been coated (the volume of the through hole 4 is reduced by coating). As is understood from FIG. 3, viscous damping by the hole can be increased by reduction of the volume of the through hole 4 by the coating film. As a result, sound-absorbing performance can be made better than that achieved by the through hole in the base material in all the frequency bands.

Figure 4:
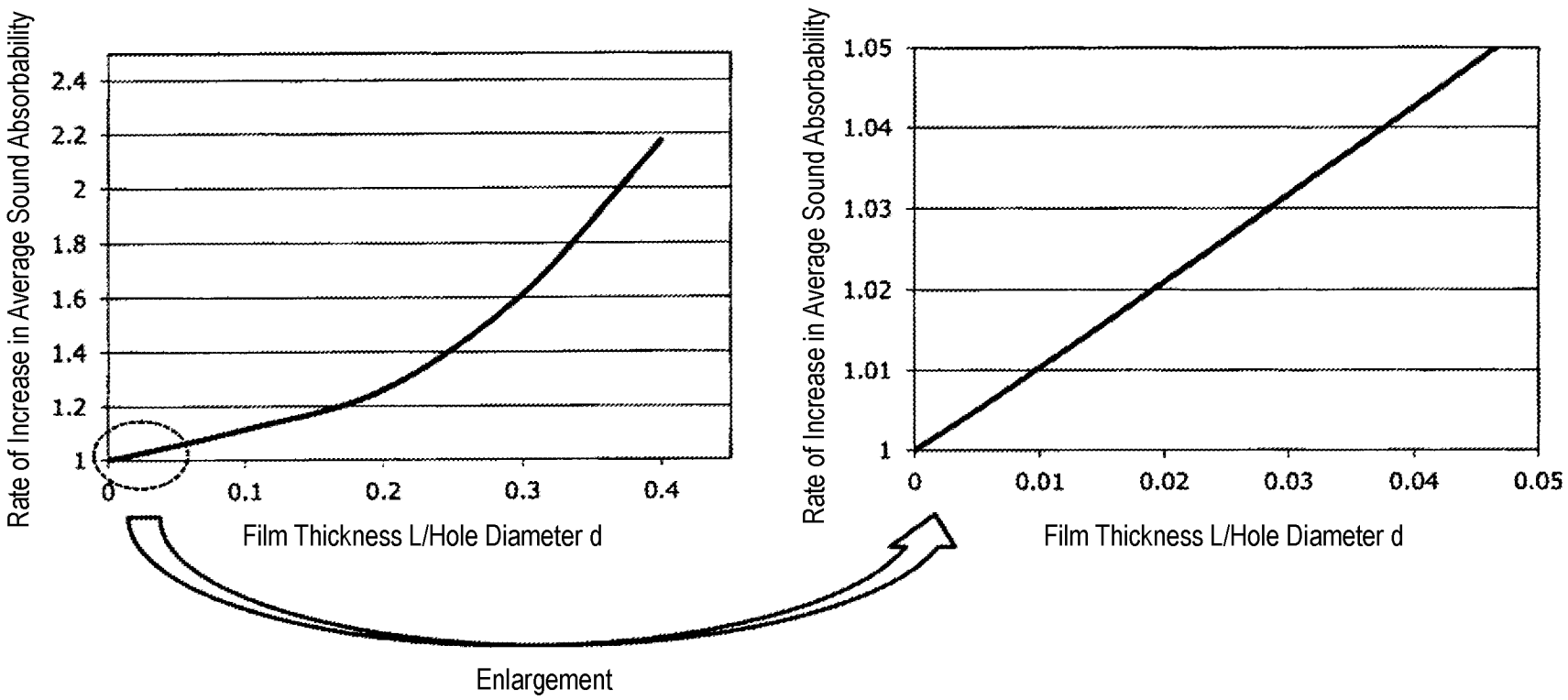
FIG. 4 A graph showing a relation between a ratio of film thickness to a hole diameter and a rate of increase in average sound absorbability.

FIG. 4 is a graph showing the relation between a ratio of film thickness L to the hole diameter d and a rate of increase in average sound absorbability. It is noted that the through hole 4 in the base material of the perforated sound absorbing plate to be analyzed is formed into a columnar shape. The "film thickness L" in the ratio of the film thickness L to the hole diameter d on the abscissa of FIG. 4 designates the film thickness of the coating film itself when the coating film having a uniform thickness is formed all over the inner wall surface of the columnar through hole 4 or designates the film thickness Lmax as the maximum film thickness when there is a difference in thickness of the coating film in the thickness direction as shown in FIG. 2.

The "average sound absorbability" designates an average of sound absorbability at 100 to 500 Hz in a perforated sound-absorbing plate in which holes each having a hole diameter d of 1 mm are made in a plate having a plate thickness of 1 mm, and the inner wall surface of the holes is coated with a coating film having a film thickness L, on the assumption that an aperture ratio in the perforated sound-absorbing plate is defined so that the sound absorbability is 1 at a sound-absorbing peak. The average sound absorbability is generally about 0.5 to 0.7. As the conditions of the through-hole part in FIG. 4, the average sound absorbability is set at 0.5, and there is no coating unevenness in the circumferential direction of the inner wall surface of the through hole 4, that is, the axis of the through hole 4 is aligned with the axis of the through-hole portion formed inside the through hole 4 by the coating film. In the graph on the right side of FIG. 4, the part where the ratio of the film thickness L to the hole diameter d is 0 to 0.05 in the graph on the left side is enlarged.

As is understood from the graph on the right side of FIG. 4, the average sound absorbability increases by 2% when the ratio of the film thickness L to the hole diameter d changes from 0 to 0.02. When the average sound absorbability increases by 2%, reflected energy decreases by about 0.1 dB. Thus, a significant difference begins to appear in the sound absorbability. That is, it is preferred that the ratio of the film thickness L to the hole diameter d is 0.02 (1/50) or more.

The reason why the reflected energy decreases by about 0.1 dB when the average sound absorbability increases by 2% will be explained based on the following formula. Er (dB) designates reflected energy (energy of a reflected wave) before improvement (before increase in average sound absorbability) and Er' (dB) designates reflected energy after the improvement. A reduction amount of the reflected energy is Δl (dB). Here, α designates average sound absorbability before the improvement (film thickness is zero), and α' designates average sound absorbability after the improvement. Ei designates energy of an input wave.

$$\begin{aligned}\Delta 1 &= Er - Er' \\ &= 10\log_{10}(1-\alpha)Ei - 10\log_{10}(1-\alpha')Ei \\ &= 10\log_{10}((1-\alpha)/(1-\alpha'))\end{aligned}$$

When $\alpha'=\alpha+0.02\alpha$ and $\alpha=0.5$ are substituted into the aforementioned formula. Δl is about 0.1 dB.

Although it is preferred that the diameter of the through-hole portion formed by the coating film is smaller, the sound-absorbing performance is reduced when the through hole 4 is closed by the coating film. Therefore, the ratio of the film thickness L to the hole diameter d is smaller than 0.5 (½). In order to more surely prevent the through hole 4 from being closed by the coating film, it is preferred that the ratio of the film thickness L to the hole diameter d is ⅓ or less.

In addition, in the embodiment shown in FIG. 2, the film thickness of the coating film is larger on the central portion (on the central part of the coating film in the thickness direction) than on an end portion in the thickness direction (on an end portion of the coating film in the thickness direction). Thus, the length in the thickness direction of a part (region) having a small hole diameter is shorter than the case where the hole has a fixed section due to a uniform coating film. As a result, the effect of viscous damping due to the hole can be improved to obtain an effect that the number of holes can be reduced to obtain the same sound-absorbing performance. In a fine perforated plate to which the present invention is applied, it is preferred that the thickness of the coating film formed on the inner wall surface of the through hole 4 (which is the thickness of the coating film itself when the coating film has a uniform thickness or the thickness of a maximum film thickness portion when the coating film does not have a uniform thickness) is 10 to 100 μm, and the hole diameter d is 0.5 mm or less.

(First Modification of First Embodiment)

Figure 5:
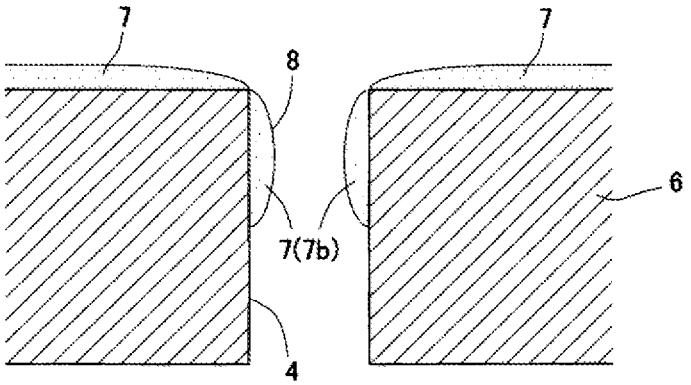
FIG. 5 A view of the through-hole part shown in FIG. 2 in the first modification.

FIG. 5 is a view of the through-hole part shown in FIG. 2 in the first modification. Although both surfaces of the perforated plate 6 are coated in the perforated sound-absorbing plate 1 shown in FIG. 1 and FIG. 2, only one surface of the perforated plate 6 is coated in this embodiment. Thus, a coating film 7*b* is formed on a part of the inner wall surface of the through hole 4. The coating film 7*b* is a mountain-like coating film in the same manner as the coating film 7*a* shown in FIG. 2. However, the coating film 7*b* is not limited thereto, but it may be a coating film having a uniform thickness at any part in the thickness direction.

When a coating film 7*b* is formed only on a part of the inner wall surface of the through hole 4, a through-hole portion whose diameter is smaller than the diameter of the through hole 4 in the base material and whose volume is smaller than the volume of the through hole 4 in the base material can be formed so that sound-absorbing performance can be made better than that achieved by the through hole 4 in the base material. In addition, when the coating film 7*b* is formed into a mountain-like shape by use of surface tension or the like, the length in the thickness direction of a part (region) having a small hole diameter is shorter than the case where the hole has a fixed section due to a uniform coating film. As a result, the effect of viscous damping due to the hole can be improved to obtain an effect that the number of holes can be reduced to obtain the same sound-absorbing performance.

The through-hole portion 8 is a hole portion formed by the surface of the coating film 7*b* and, of the inner wall surface of the through hole 4, the surface where the coating film 7*b* is absent (the surface which has not been coated) (the same can be applied to other embodiment(s) in which a part of an inner wall surface of a through hole in a base material is coated as will be described later).

(Second Modification of First Embodiment)

Figure 6:
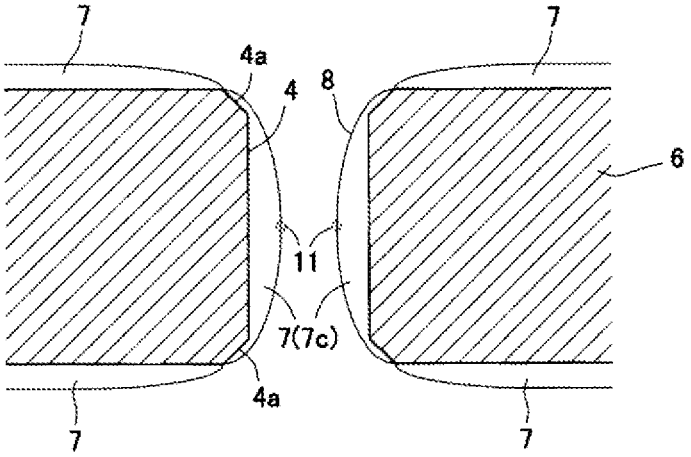
FIG. 6 A view of the through-hole part shown in FIG. 2 in the second modification.

FIG. 6 is a view of the through-hole part shown in FIG. 2 in the second modification. In this embodiment, both hole end portions 4*a* of the through hole 4 of the perforated plate 6 as a base material are chamfered. Thus, a coating film 7*c* formed on the inner wall surface of the through hole 4 is larger in degree of curvature than the coating film 7*a* in FIG. 2, so that a region (region around the ridge portion 11) where the hole diameter is reduced in the thickness direction by coating is reduced in comparison with the case of the perforated plate 6 where the hole end portion is not chamfered as shown in FIG. 2. As a result, the effect of viscous damping due to the hole can be improved to obtain an effect that the number of holes can be reduced to obtain the same sound-absorbing performance.

Second Embodiment

Figure 7:
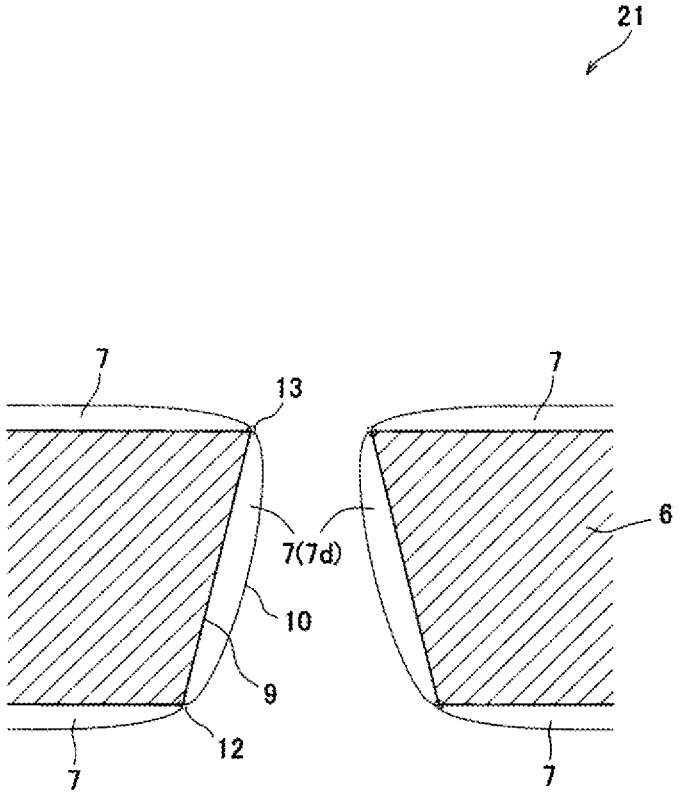
FIG. 7 An enlarged view of a through-hole part of a perforated sound-absorbing plate in the second embodiment of the present invention.

FIG. 7 is an enlarged view of a through-hole part of a perforated sound-absorbing plate 21 in the second embodiment of the present invention. The through hole 4 formed in the perforated plate 6 as a base material shown in FIG. 2, FIG. 5 or FIG. 6 is a columnar hole. On the other hand, the through hole 9 formed in the perforated plate 6 (base material) in this embodiment is formed into a circular truncated cone-like hole. The through hole 9 includes a maximum hole diameter portion 12 formed in one surface of the perforated plate 6 and a minimum hole diameter portion 13 formed in the other surface of the perforated plate 6. The hole diameter of the through hole 9 increases gradually from the minimum hole diameter portion 13 toward the maximum hole diameter portion 12.

The through hole 9 in this embodiment is classified into a shape like a right circular truncated cone (circular truncated cone symmetrical about its own axis) of a shape like a circular truncated cone. However, the through hole 9 may be a through hole formed into an obliquely circular truncated cone. Further, the shape of the through hole 9 is not limited to the circular truncated cone, but any shape may be used as long as the hole diameter is increased gradually from the minimum hole diameter portion 13 toward the maximum hole diameter portion 12, as described above (the same can be applied to a circular truncated cone-like hole 14*b* of a through hole 14 in the third embodiment which will be described later).

A coating film 7*d* is formed all over the inner wall surface of the through hole 9, and a through-hole portion 10 whose volume is smaller than the volume of the through hole 9 is formed by the coating film 7*d*.

When the shape of the through hole 9 is tapered, the place where the hole diameter is smallest can be limited to the minimum hole diameter portion 13. Thus, it is possible to reduce the risk that the hole may be closed due to accuracy in hole shape, a variation in coating film thickness or the like.

The perforated sound-absorbing plate 21 may be disposed so that the surface on the minimum hole diameter portion 13 faces the noise source 5 or the surface on the maximum hole diameter portion 12 faces the noise source 5 (the same can be applied to perforated sound-absorbing plates having through-hole parts shown in FIG. 8 to FIG. 12).

(First Modification of Second Embodiment)

Figure 8:
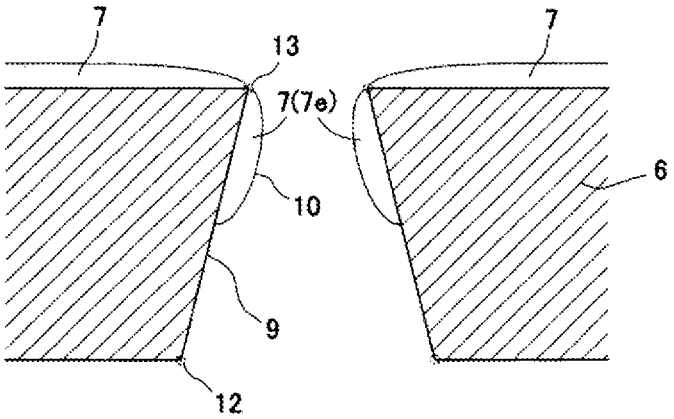
FIG. 8 A view of the through-hole part shown in FIG. 7 in the first modification.

FIG. 8 is a view of the through-hole part shown in FIG. 7 in the first modification. Only the surface of the perforated plate 6 on the minimum hole diameter portion 13 side is coated in this embodiment. Thus, a coating film 7*e* is formed only on the minimum hole diameter portion 13 side of the inner wall surface of the through hole 9. With this configuration, the aforementioned effect that it is possible to reduce the risk that the hole may be closed due to accuracy in hole shape, a variation in coating film thickness or the like can be achieved by a smaller amount of coating.

(Second Modification of Second Embodiment)

Figure 9:
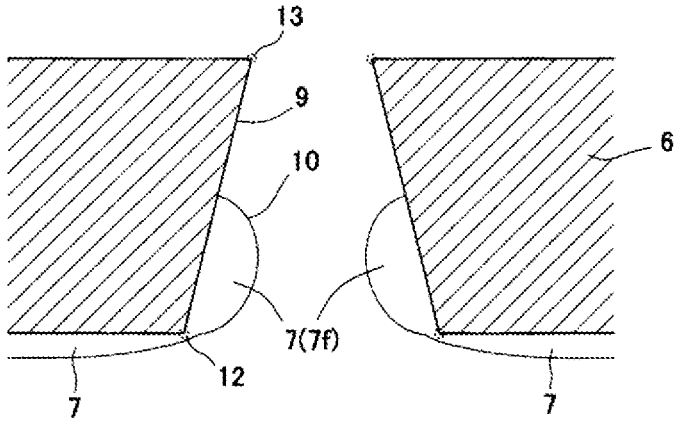
FIG. 9 A view of the through-hole part shown in FIG. 7 in the second modification.

FIG. 9 is a view of the through-hole part shown in FIG. 7 in the second modification. Only the surface of the perforated plate 6 on the maximum hole diameter portion 12 side is coated in this embodiment. Thus, a coating film 7*f* is formed only on the maximum hole diameter portion 12 side of the inner wall surface of the through hole 9. With this configuration, the hole diameter can be reduced as a whole by the coating film 7*f* (the volume of the hole can be reduced) while the diameter of the minimum hole diameter portion 13 is maintained. Thus, viscous damping in the hole portion can be improved.

Of the through-hole portion 10 formed by the surface of the coating film 7*f* and the surface where the coating film 7*f* is absent (the hole surface which has not been coated), the inner diameter of the coating film 7*f* portion is smaller than the inner diameter of the minimum hole diameter portion 13. That is, due to the coating film 7*f*, the through-hole portion 10 has a diameter portion whose diameter is smaller than the minimum diameter of the through hole 9 as a base material. Here, a sound absorbing effect is determined by a pressure loss generated when a sound wave passes through the hole. The pressure loss depends largely on the smallest part of the hole. Therefore, a larger sound absorbing effect can be obtained when the inner wall surface of the through hole 9 is coated to reduce the hole volume while a hole portion whose diameter is smaller than that of the minimum hole diameter portion 13 of the through hole 9 in the base material is formed.

Third Embodiment

Figure 10:
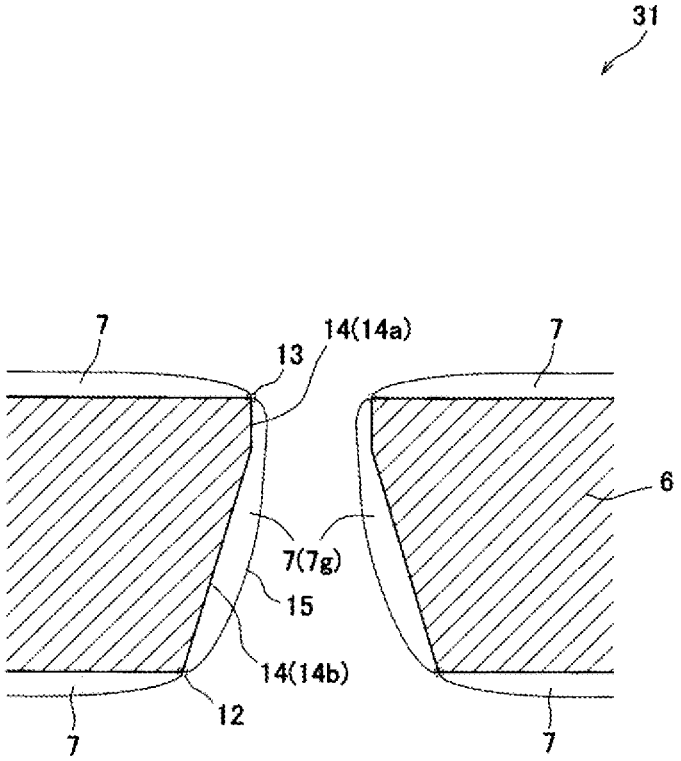
FIG. 10 An enlarged view of a through-hole part of a perforated sound-absorbing plate in the third embodiment of the present invention.

FIG. 10 is an enlarged view of a through-hole part of a perforated sound-absorbing plate 31 in the third embodiment of the present invention. A through hole 14 formed in the perforated plate 6 (base material) in this embodiment includes a maximum hole diameter portion 12 formed in one surface of the perforated plate 6 and a minimum hole diameter portion 13 formed in the other surface of the perforated plate 6. This point is the same as the through hole 9 shown in FIG. 7 to FIG. 9. In this embodiment, from the minimum hole diameter portion 13 toward the maximum hole diameter portion 12, the through hole 14 is formed as a columnar hole 14*a* having the same diameter as the minimum hole diameter portion 13 from the beginning to the middle thereof and is formed as a circular truncated cone-like hole 14*b* whose hole diameter is expanded gradually from the middle thereof. The columnar hole 14*a* is a part which keeps the same diameter as the minimum hole diameter portion 13.

A coating film 7*g* is formed all over the inner wall surface of the through hole 14, and a through-hole portion 15 whose volume is smaller than the volume of the through hole 14 is formed by the coating film 7*g*.

In the perforated sound-absorbing plate 31 in this embodiment, the shape of the through hole 14 is tapered so that the place where the hole diameter is smallest can be limited to the minimum hole diameter portion 13, in the same manner as in the perforated sound-absorbing plate 21 in the second embodiment shown in FIG. 7. Thus, it is possible to reduce the risk that the hole may be closed due to accuracy in hole shape, a variation in coating film thickness or the like. In addition, the length in the thickness direction of the columnar hole 14*a* whose diameter is the smallest can be changed to easily control the damping of a sound wave in the hole portion.

(First Modification of Third Embodiment)

Figure 11:
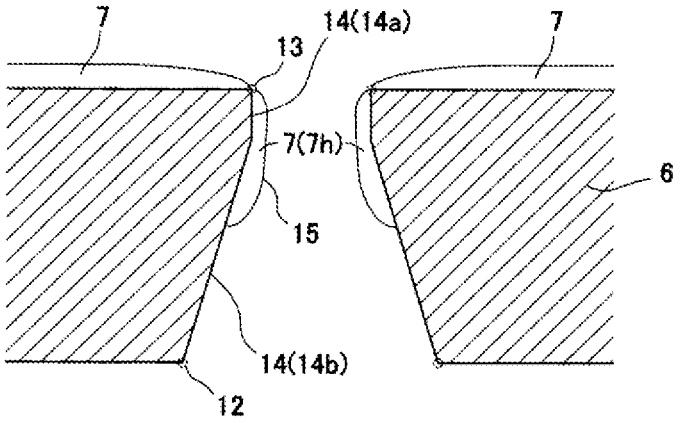
FIG. 11 A view of the through-hole part shown in FIG. 10 in the first modification.

FIG. 11 is a view of the through-hole part shown in FIG. 10 in the first modification. Only the surface of the perforated plate 6 on the minimum hole diameter portion 13 side is coated in this embodiment. Thus, a coating film 7*h* is formed only on the minimum hole diameter portion 13 side of the inner wall surface of the through hole 14. With this configuration, the aforementioned effect that it is possible to reduce the risk that the hole may be closed due to accuracy in hole shape, a variation in coating film thickness or the like can be achieved by a smaller amount of coating. There is another effect that the length in the thickness direction of the columnar hole 14*a* whose diameter is the smallest can be changed to easily control the damping of a sound wave in the hole portion.

(Second Modification of Third Embodiment)

Figure 12:
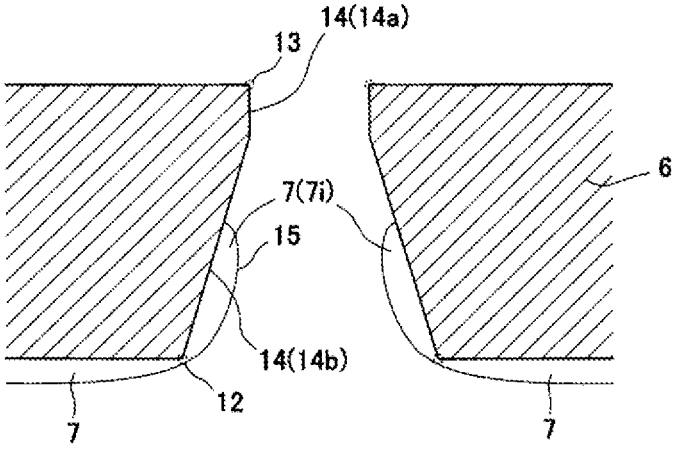
FIG. 12 A view of the through-hole part shown in FIG. 10 in the second modification.

FIG. 12 is a view of the through-hole part shown in FIG. 10 in the second modification. Only the surface of the perforated plate 6 on the maximum hole diameter portion 12 side is coated in this embodiment. Thus, a coating film 7*i* is formed only on the maximum hole diameter portion 12 side of the inner wall surface of the through hole 14. With this configuration, the hole diameter can be reduced as a whole due to the coating film 7*i* (the volume of the hole can be reduced) while the diameter of the minimum hole diameter portion 13 is maintained. Thus, viscous damping in the hole portion can be improved. There is another effect that the length in the thickness direction of the columnar hole 14*a* whose diameter is the smallest can be changed to easily control the damping of a sound wave in the hole portion.

MODIFICATIONS

Although a columnar hole is illustrated in FIG. 2, FIG. 5 and FIG. 6 as the through hole 4 formed in the perforated plate 6 as a base material, the columnar hole may be replaced by a through hole having a polygonal shape in section such as a triangular shape in section or a quadrangular shape in section, or may be replaced by a through hole having an elliptic or oval shape in section. Although a hole having a circular truncated cone-like shape is illustrated in FIG. 7 to FIG. 12 as the through hole 9 or 14 formed in the perforated plate 6 as a base material, the hole may be replaced by a through hole having an angular truncated cone-like shape. In the perforated sound-absorbing plate in the present invention, it is essential that the inner wall surface of the through hole made in the base material is coated without closing the through hole.

In the aforementioned embodiments, a coating film is formed circumferentially all over the inner wall surface of the through hole 4, 9 or 14. However, the coating film may be formed only on a part, in the circumferential direction, of the inner wall surface of the through hole 4, 9 or 14 so that a through-hole portion whose volume is smaller than the volume of the through hole 4 is formed by the coating film.

The present application is based on Japanese patent application No. 2015-231451 filed on Nov. 27, 2015, and Japanese patent application No. 2016-120172 filed on Jun. 16, 2016, the contents of which are incorporated herein by reference.

DESCRIPTION OF REFERENCE NUMERALS AND SIGNS

1: Perforated sound-absorbing plate
2: Closing member

3: Air layer
4: Through hole
5: Noise source
6: Perforated plate (base material)
7: Coating film
8: Through-hole portion (hole formed by coating film)

The invention claimed is:

1. A perforated sound-absorbing plate comprising a perforated plate as a base material in which a large number of through holes are formed, wherein:

a coating film is provided on an inner wall surface of the through hole, and a through-hole portion whose volume is smaller than a volume of the through hole is formed by the coating film;

the through hole is a columnar hole; and along the inner wall surface of the through hole, the coating film has a thickness, in a direction perpendicular to the inner wall surface, that gradually increases such that the thickness of the coating film is largest at a central portion of the inner wall surface and smallest at each end portion of the inner wall surface.

2. The perforated sound-absorbing plate according to claim 1, wherein:

a hole end portion of the through hole is chamfered.

3. The perforated sound-absorbing plate according to claim 1, wherein:

the inner wall surface of the through hole is coated so that the thickness of the coating film is smaller than ½ of a diameter of the through hole.

4. The perforated sound-absorbing plate according to claim 3, wherein:

the inner wall surface of the through hole is coated so that the thickness of the coating film is not smaller than 1/50 of the diameter of the through hole.

5. The perforated sound-absorbing plate according to claim 1, wherein:

the coating film is provided on a part of the inner wall surface of the through hole.

6. The perforated sound-absorbing plate according to claim 2, wherein:

the coating film is provided on a part of the inner wall surface of the through hole.

7. The perforated sound-absorbing plate according to claim 3, wherein:

the coating film is provided on a part of the inner wall surface of the through hole.

8. The perforated sound-absorbing plate according to claim 4, wherein:

the coating film is provided on a part of the inner wall surface of the through hole.

* * * * *